US009441434B2

(12) United States Patent
Wilson et al.

(10) Patent No.: US 9,441,434 B2
(45) Date of Patent: Sep. 13, 2016

(54) PRESSURE CORE BARREL FOR RETENTION OF CORE FLUIDS AND RELATED METHOD

(71) Applicant: National Oilwell Varco, L.P., Houston, TX (US)

(72) Inventors: Bobby Talma Wilson, Litchfield Park, AZ (US); David Young McGehee, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 148 days.

(21) Appl. No.: 14/253,386

(22) Filed: Apr. 15, 2014

(65) Prior Publication Data

US 2014/0305712 A1 Oct. 16, 2014

Related U.S. Application Data

(60) Provisional application No. 61/812,067, filed on Apr. 15, 2013.

(51) Int. Cl.
*E21B 25/02* (2006.01)
*E21B 25/08* (2006.01)
*E21B 25/06* (2006.01)

(52) U.S. Cl.
CPC ..... *E21B 25/02* (2013.01); *E21B 25/06* (2013.01); *E21B 25/08* (2013.01)

(58) Field of Classification Search
CPC ..... E21B 49/02; E21B 25/02; E21B 25/06; E21B 25/08
See application file for complete search history.

(56) References Cited

U.S. PATENT DOCUMENTS 3,064,742 A * 11/1962 Bridwell ..... E21B 25/08 175/226
3,146,837 A * 9/1964 Bridwell ..... E21B 25/08 175/244
3,163,241 A * 12/1964 Daigle ..... E21B 25/00 175/20
3,454,117 A * 7/1969 Eckel ..... E21B 25/08 175/226
3,874,465 A * 4/1975 Young ..... E21B 25/02 175/236
4,230,192 A * 10/1980 Pfannkuche ..... E21B 25/08 175/233
4,256,192 A 3/1981 Aumann
(Continued)

FOREIGN PATENT DOCUMENTS

WO 0006866 2/2000

OTHER PUBLICATIONS

Combined Search and Examination Report dated Oct. 17, 2014 for corresponding GB Application No. GB1406743.3 (5 pgs.).
(Continued)

*Primary Examiner* — Shane Bomar
(74) *Attorney, Agent, or Firm* — Derek V. Forinash; Porter Hedges LLP

(57) ABSTRACT

A pressure coring apparatus comprises a housing having an upper end and a lower end. A valve is coupled to the lower end of the housing and has an open position for entrance of a core and a closed position for retaining and sealing the core within the housing. A piston assembly is moveably disposed within the housing. A first volume is defined within the housing and between the upper end of the housing and the piston assembly. A second volume is defined within the housing between the lower end of the housing and the piston assembly. A pressure relief device is disposed through the housing and operable to maintain pressure within the first volume and the second volume below a target pressure.

11 Claims, 2 Drawing Sheets

(56) References Cited

U.S. PATENT DOCUMENTS

| | | | | |
|---|---|---|---|---|
| 4,272,987 | A | 6/1981 | Aumann et al. | |
| 4,372,174 | A | 2/1983 | Cymbalisty et al. | |
| 4,512,419 | A | 4/1985 | Rowley et al. | |
| 4,512,423 | A | 4/1985 | Aumann et al. | |
| 4,573,539 | A | 3/1986 | Carroll et al. | |
| 4,598,777 | A * | 7/1986 | Park | E21B 25/08 175/226 |
| 4,950,844 | A * | 8/1990 | Hallmark | E21B 49/06 175/233 |
| 5,163,522 | A | 11/1992 | Eaton et al. | |
| 5,253,720 | A | 10/1993 | Radford et al. | |
| 6,009,960 | A * | 1/2000 | Leitko, Jr. | E21B 25/08 175/250 |
| 6,216,782 | B1 | 4/2001 | Skinner | |
| 6,216,804 | B1 | 4/2001 | Aumann et al. | |
| 6,230,825 | B1 | 5/2001 | Aumann et al. | |
| 6,305,482 | B1 | 10/2001 | Aumann et al. | |
| 6,378,631 | B1 | 4/2002 | Aumann et al. | |
| 6,659,204 | B2 | 12/2003 | Aumann et al. | |
| 6,702,017 | B1 | 3/2004 | Corrigan et al. | |
| 6,719,070 | B1 * | 4/2004 | Puymbroeck | E21B 25/06 175/20 |
| 7,537,062 | B2 | 5/2009 | Hughes et al. | |
| 7,600,580 | B2 | 10/2009 | Cravatte et al. | |
| 7,669,469 | B2 * | 3/2010 | Shammai | E21B 49/082 436/25 |
| 7,878,269 | B2 | 2/2011 | Cravatte | |
| 7,913,775 | B2 * | 3/2011 | Jeffryes | E21B 10/00 175/249 |
| 8,122,976 | B2 | 2/2012 | Bartette et al. | |
| 8,684,110 | B2 | 4/2014 | Reid et al. | |
| 2002/0033281 | A1 | 3/2002 | Aumann et al. | |
| 2012/0234607 | A1 | 9/2012 | Kinsella | |

OTHER PUBLICATIONS

Combined Search and Examination Report dated Oct. 21, 2014 for corresponding UK Application No. UK1406743.3 (2 pgs.).

* cited by examiner

PRESSURE CORE BARREL FOR RETENTION OF CORE FLUIDS AND RELATED METHOD

CROSS-REFERENCE TO RELATED APPLICATIONS

This application claims the benefit under 35 U.S.C. §119 (e) of U.S. Provisional Patent Application No. 61/812,067 filed Apr. 15, 2013, the disclosure of which is hereby incorporated herein by reference.

BACKGROUND

The field of the invention is pressure coring and more particularly a barrel that retains gasses and liquids from the core while controlling core pressure as the core is removed from the wellbore and a related coring method.

Formation coring is a well-known process for obtaining a sample of a subterranean formation for analysis. In coring operations, a specialized drilling assembly is used to obtain a cylindrical sample of material, or "core," from the formation so that the core can be brought to the surface. Once at the surface, the core can be analyzed to reveal formation data such as permeability, porosity, and other formation properties that provide information as to the type of formation being drilled and/or the types of fluids contained within the formation. Coring operations include bottom-hole coring, where a sample is taken from the bottom of the wellbore, and sidewall coring, where a sample is taken from the wall of the wellbore. Coring operations can also be performed using conventional wellbore tubulars, such as drill string, or using wireline conveyed tools.

As cores obtained from a formation under pressure are retrieved to the surface using conventional coring methods, the fluids and gases entrained in that core will flow out of the core as the core is retrieved to the surface as the confining pressure from the drilling fluid become less than the formation pressure. Because it may be desirable to analyze the fluids and gasses entrained in a core sample, pressure coring equipment was developed to address this issue. In general, pressure coring seeks to retrieve a core sample to the surface while either maintaining any entrained fluids or gasses in the core, or capturing those fluids or gasses as they escape the core. Many pressure coring tools utilize core barrels that are designed to enclose the core and retain the liquids and gasses that may be entrained within, or escape from, the core.

In some cases, the core barrel was equipped with a pressure safety device, such as a relief valve or a rupture disc, to prevent excess pressure from building up in the core barrel. In the case of a rupture disc, once the predetermined pressure was exceeded in the core barrel, the disc would break and any gasses from the core could escape the core barrel. A relief valve would allow some of the core gasses to vent until the pressure was reduced to a predetermined value. At that point the relief valve would hopefully reseat and retain some of the core gasses even though some of the gasses would be lost from the barrel in the venting event. Rupture discs have also been used in tandem with relief valves so that if for any reason the relief valve failed to open, the rupture disc could function and prevent overpressure of the core. Whether opening a relief valve or breaking a rupture disk, less than 100% of the gasses and fluids from the core sample would have been recovered.

FIG. 1 illustrates schematically a pressure core inner barrel 10 that is inside an outer core barrel 12 and is retrieved to the surface through the inside of the drill pipe with a wireline, slickline, or drill string 14. A bit 16 has an opening 18 through which the core 20 passes when the closure valve 22 is in the open position and the bit 16 is making hole. After a predetermined footage of making hole, the valve 22 is closed and the core 20 is sealed inside the barrel 10. With the valve 22 closed, the inner barrel 10 forms a sealed vessel pressurized to the hydrostatic pressure in the borehole when the sample was taken. As the string 14 pulls the inner barrel 10 upward, the hydrostatic pressure decreases and the pressure differential across the inner barrel 10 increases. As mentioned before, there could be a relief valve or rupture disc (not shown) that would relieve the confined pressure inside of the core barrel 10 on the way to the surface if the differential pressure would exceed the pressure rating of the rupture disc, or the preset relief valve pressure, in order to prevent internal pressure from exceeding the rated pressure of the barrel 10. As previously stated such pressure relief would result in a loss of some or all the fluids and gasses that were entrained in the core 20 when it was removed from the formation. The pressure retained in the core barrel may also be optionally recovered to the surface by tripping the drill string.

As wells were drilled deeper, such as in the Gulf of Mexico, the hydrostatic pressures in those wellbores reached 15,000 PSI, or more. These high pressures made the design of core barrels suitable to contain the expected pressure difficult. For example, the increased wall thickness needed to contain high differential pressures made it difficult to design coring tools that could obtain a core of desired diameter. Furthermore, at the surface there were added safety concerns due to the high pressure contained in the core barrel and the need to remove the core from the barrel so that the core could be analyzed.

Thus, there is a continuing need in the art for methods and apparatus for acquiring cores that overcome these and other limitations of the prior art.

BRIEF SUMMARY OF THE DISCLOSURE

A pressure coring apparatus comprises a housing having an upper end and a lower end. A valve is coupled to the lower end of the housing and has an open position for entrance of a core and a closed position for retaining and sealing the core within the housing. A piston assembly is moveably disposed within the housing. A first volume is defined within the housing and between the upper end of the housing and the piston assembly. A second volume is defined within the housing between the lower end of the housing and the piston assembly. A pressure relief device is disposed through the housing and operable to maintain pressure within the first volume and the second volume below a target pressure.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
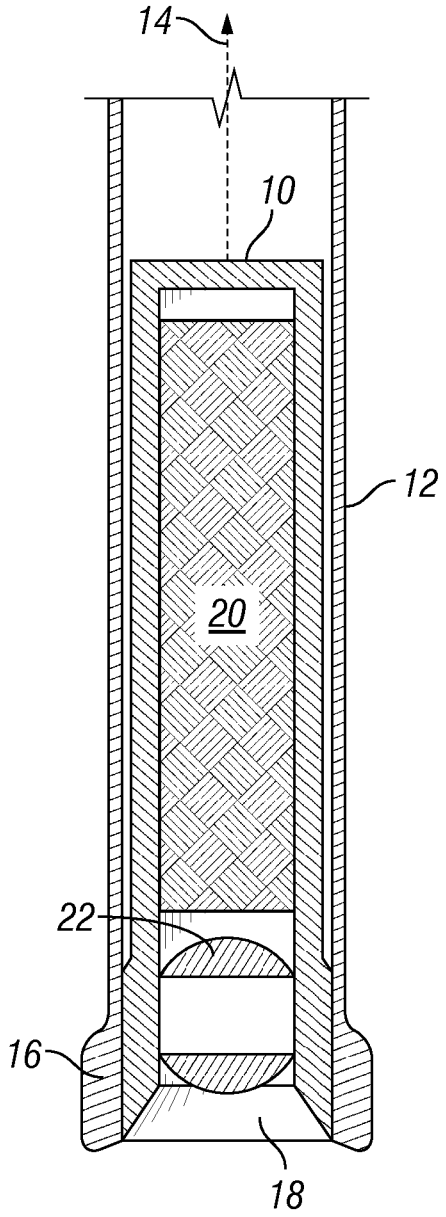
FIG. 1 (Prior Art)
FIG. 1 is a schematic representation of a prior art pressure core barrel assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring to FIG. 2-6, the inner core barrel assembly 30 of a pressure coring apparatus is shown for clarity without the surrounding string, outer barrel, drill bit, or the wellbore in which the string and bit are disposed. The inner core barrel assembly 30 includes a housing 32, a valve 34, and a piston assembly 38. The valve 34 is selectively sealingly engaged with the lower end 36 of the housing 32. The piston assembly 38 is disposed within and sealingly engaged with the housing 32.

Figures 2, 3, 4, 5, 6:
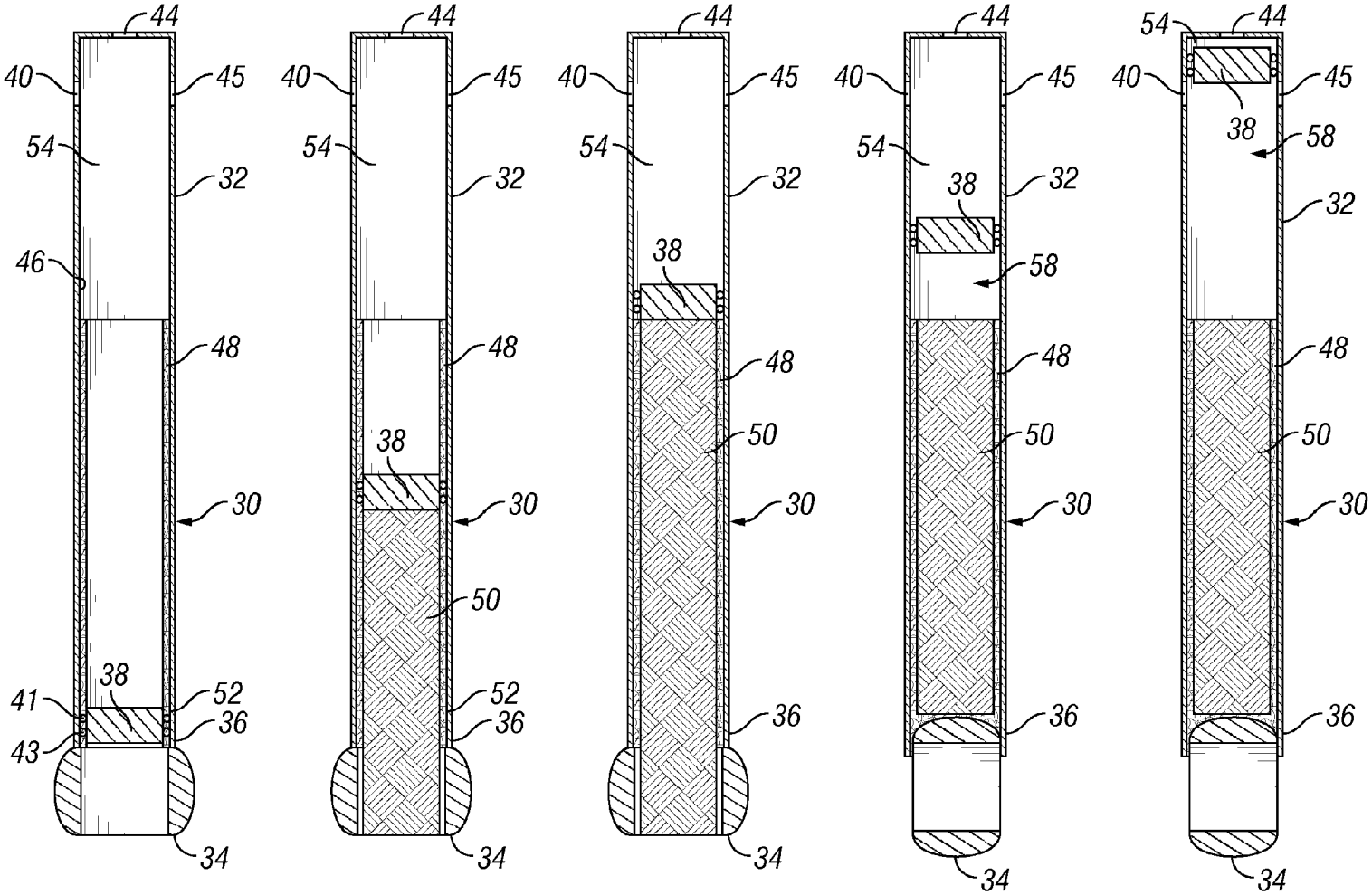
FIG. 2 is the core barrel assembly of the present invention in the running in position.
FIG. 3 is the view of FIG. 2 in the capturing the core configuration.
FIG. 4 is the view of FIG. 3 in the coring complete configuration.
FIG. 5 is the view of FIG. 4 in the recovery trip up the wellbore.
FIG. 6 is the view of FIG. 5 in the recovered configuration at the surface.

The housing 32 may be a substantially cylindrical body that, with valve 34 in a closed position, forms a pressure vessel built to a desired pressure rating. Valve 34 may be run in an open position, as shown in FIG. 2, and may preferably be remotely moved to a closed position after the core 50 is captured. While valve 34 is shown as a ball valve, other types of remotely operated closures are envisioned for isolation of the lower end 36 of the housing 32.

The piston assembly 38 may include peripheral seals 41 and 43 to sealingly engage the housing 32. This depiction is schematic and the assembly can have a single or multiple pistons with fewer or greater numbers of peripheral seals. When multiple pistons are used they can abut for tandem movement or they can be secured to each other for tandem movement. The piston assembly 38 sealingly engages the housing 32 creating a first volume 54 that is hydraulically isolated from a second volume 58. The piston assembly 38 may have an initial position coupled to the housing by a shear pin 52, or other releasable device, and can move longitudinally though the housing 32 in response to differential pressure across the piston assembly 38 or physical contact with the core 50.

The housing 32 includes a pressure relief device 40 located near the upper end of the housing 32. The pressure relief device 40 may be an adjustable pressure relief valve or a pressure limiting rupture disc that is operable to repeatedly open and close in response to differential pressure. The pressure relief device 40 is configured so as to maintain a differential pressure between the housing 32 and the surrounding environment below a selected threshold, or relief pressure.

The relief pressure may be selected so that the pressure rating of the housing 32 can be kept to a low level and/or for safety reasons involved in handling the pressurized housing 32 at the surface. Ideally the relief pressure is higher than the pressure at which gasses will migrate out of the core, however operational safety limits and space constraints in the wellbore may dictate a far lower relief pressure in order to accommodate the size of the core being retrieved and the necessary wall thickness for housing 32. The relief pressure may be selected so as to hold pressure within the housing 32 above the formation "bubble point," where the bubble point is the pressure at which core gasses come out of solution and migrate out of the core. Additionally, the relief pressure may also be adjusted by changing the length of the housing 32 or the travel of the piston assembly 38.

The housing 32 may also include a valved opening 44 and a rupture disk 45, or other secondary pressure relief device. The valved opening 44 allows admission of a preferably incompressible fluid into the first volume 54. The fluid may be introduced at relatively low preload pressure, such as about 150 PSI, or other pressures as desired. The preferred preload pressure is less than a set point for the pressure relief device 40 and the rupture disk 45. The rupture disk 45 provides a safety valve to allow pressure to be vented from housing 32 in the event that the pressure relief device 40 fails to operate properly.

In certain embodiments, the inside wall 46 may have an liner 48 that is preferably at least as long as the intended core 50 shown fully inside the housing 32 in FIG. 4. The liner 48 is preferably an absorbent felt design to capture and retain liquids that seep out of the core 50 as the barrel assembly 30 is raised to the surface and retained pressure is allowed to reduce below the bubble point. The liner 48 is fully optional and offers an advantage of retaining the fluids that come out of the core in substantially the same location such fluids were in when the core 50 entered the housing 32. The texture and thickness of the liner 48 is selected so that the piston assembly 38 can travel over the liner 48 while avoiding damage to themselves and holding the peripheral seal to the inside wall 46 as the piston 38 rises in response to entry of core 50.

The sequence of operation is illustrated in FIGS. 3-6 once the coring begins. As previously discussed, the first volume 54 is filled with a preferably incompressible fluid through valved opening 44 to a preload pressure that is less than the relief pressure of the relief device 40. The valved opening 44 is closed and the first volume 54 is fluidicly isolated from the wellbore during running. Valve 34 is also in a closed position so that housing 32 is fluidicly isolated from the wellbore during running.

To begin coring, valve 34 is open so that a core 50 can move through the valve 34 into the housing 32. FIG. 3 shows part of the core 50 going through the open valve 34 with the result that the piston assembly 38 is physically displaced upwardly. In certain embodiments, the piston assembly 38 may have a higher, or lower, initial position at the onset of coring than shown in FIG. 2 to leave some portion of the inside wall 46 exposed at the coring onset. However, if the objective is to collect the core 50 with as few well non-formation drilling fluids as possible so the lowermost position of the piston assembly 38 shown in FIG. 2 is preferred.

The entering core 50 pushes the piston assembly 38 upward as the core 50 enters the housing 32. Note that the first volume 54 decreases as the piston assembly 38 is forced upward. As the first volume 54 decreases, the pressure within in the first volume 54 will increase until the relief device 40 opens and allows some of the fluid within the first volume 54 to be expelled. Coring operations continue until the desired core length is obtained at which point the valve 34 is closed as shown in FIG. 5. During coring operations, the first volume 54 has continued to decrease as the core 50 continues to push the piston assembly 38 upward as a result of contact with the leading end of the core 50. The relief device 40 will continue to release fluid from within the first volume 54 as long as the pressure differential across the relief device is greater than the relief pressure of the relief device 40.

Once coring operations are complete, valve 34 is moved to a closed position, as shown in FIG. 6, which closes the lower end 36 of the housing 32. Once valve 34 is closed, the core 50 is contained within the sealed second volume 58 between the piston assembly 38 and the valve 34. The core 50 will be in full contact with the liner 48 and will be held in a generally fixed position. The housing 32 can then pulled to the surface.

As the housing 32 moves upward through the wellbore, the surrounding hydrostatic pressure outside the housing 32 decreases. This decreasing hydrostatic pressure creates a pressure differential across the relief device 40, which causes the relief device 40 to open and release fluid from the first volume 54. Releasing fluid from the first volume 54 allows the piston assembly 38 to move upward, which increases the volume contained in the second volume 58. This increasing volume in second volume 58 allows the pressure within the second volume 58 to decrease until the differential pressure across the piston assembly 38 equalizes and the differential pressure across the relief device 40 decreases below the relief pressure.

As the housing 32 continues to be raised to the surface, relief device 40 will open and close as necessary to maintain the differential pressure across the relief device 40 at a level below the relief pressure. The pressures within the first volume 54 and second volume 58 remain equalized at a target pressure effectively equivalent to the hydrostatic pressure plus the relief pressure. As the pressures remain equalized, the piston assembly 38 will move upward, thereby decreasing the first volume 54 and increasing the second volume 58. As a result, gasses and fluids entrained in the core 50 leave the core and fill the second volume 58 as the core 50 is retrieved to the surface. Fluids that leave the core 50 may be retained by the liner 48.

As the relief device 40 releases fluid from the first volume 54, the piston assembly 38 moves toward the top of the housing 32. As shown in FIG. 6 the piston assembly 38 has reached the upper travel limit essentially minimizing the first volume 54 and maximizing the second volume 58. The second volume 58 holds the gasses that were in the core 50 initially at hole bottom pressure but now that the second volume 58 has been dramatically increased, the internal pressure around the core 50 is at a desired target pressure of hydrostatic pressure plus the relief pressure. Considering the principle of Boyles law: $P_1V_1$ equals $P_2V_2$, the retained pressure in the second volume 58, $P_2$ is significantly reduced by the enlargement of $V_2$ in the second volume 58.

For many situations, the second volume 58 is sized so that no core gas has escaped the second volume 58 while avoiding overpressure of the housing 32. The use of the piston assembly 38 with external peripheral seals 41 and 43 allows the gasses and liquids from the core 50 to be contained in a single increasing volume as the housing 32 is removed from the borehole.

Once at the surface, connections can be made to surface testing equipment to measure retained pressure, and remove a gas sample for further analysis. After the confined pressure inside the housing 32 has been bled off, and decreased to a safe level, the bottom valve 34 can then be opened to remove the core under controlled conditions at the surface for further testing and analysis in a known manner.

Those skilled in the art will also appreciate that valve 34 can be run in closed to keep out well fluids when running in. If that is done then the valve has to be remotely opened to allow coring to start and then closed after the coring is concluded. However, being able to open and then close the valve 34 would also provide the option of eliminating the piston 38 and simply providing enough volume above the core 50 inside the housing 32 for the core gas to expand to a desired target pressure at the surface. However, in so doing some of the core gas or liquid can be vented during the trip out of the hole thru relief device 40.

The above description is illustrative of the preferred embodiment and many modifications may be made by those skilled in the art without departing from the invention whose scope is to be determined from the literal and equivalent scope of the claims below: While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A pressure coring apparatus comprising:

a housing having an upper end and a lower end;

a valve coupled to the lower end of the housing and having an open position for entrance of a core and a closed position for retaining and sealing the core within the housing;

a piston assembly moveably disposed within the housing, wherein a first volume is defined within the housing and between the upper end of the housing and the piston assembly, and wherein a second volume is defined within the housing between the lower end of the housing and the piston assembly; and a pressure relief device disposed through the housing and operable to release fluid from within the first volume as the pressure coring apparatus is moved out of the wellbore so as to maintain pressure within the first volume and the second volume below a target pressure, wherein, in use, the piston assembly is movable from a position adjacent the valve toward the upper end of the housing as the core enters the housing.

2. The pressure coring apparatus of claim 1, wherein the first volume is filled with an incompressible fluid.

3. The pressure coring apparatus of claim 1, further comprising a secondary relief device disposed in the housing.

4. The pressure coring apparatus of claim 1, further comprising a liner disposed within the housing.

5. The pressure coring apparatus of claim 1, wherein the housing of the pressure coring apparatus has a body, and wherein the pressure relief device is operable to maintain a pressure differential across the body of the housing below the target pressure while the pressure coring apparatus is moved out of the wellbore.

6. The pressure coring apparatus of claim 5, wherein the pressure relief device comprises an adjustable pressure relief valve.

7. A pressure coring method, comprising:

using a pressure coring apparatus that includes a housing having an upper end and a lower end, a valve coupled to the lower end of the housing and having an open position for entrance of a core and a closed position for retaining and sealing the core within the housing, a piston assembly moveably disposed within the housing, wherein a first volume is defined within the housing and between the upper end of the housing and the piston assembly, and wherein a second volume is defined within the housing between the lower end of the housing and the piston assembly, and a pressure relief device disposed through the housing and operable to release fluid from within the first volume as the pressure coring apparatus is moved out of the wellbore so as to maintain pressure within the first volume and the second volume below a target pressure, wherein, in use, the piston assembly is movable from a position adjacent the valve toward the upper end of the housing as the core enters the housing;

injecting an incompressible fluid into the first volume;

disposing the pressure coring apparatus into a wellbore;

admitting a core into the lower end of the housing;

closing the valve so that the core is disposed within the second volume;

moving the pressure coring apparatus out of the wellbore;

maintaining pressure within the first volume and the second volume below the target pressure by activating the pressure relief device while moving the pressure coring apparatus out of the wellbore; and moving the piston assembly relative to the housing so as to increase the second volume while capturing any gasses or fluids emitted from the core.

8. The pressure coring method of claim 7, wherein the target pressure is higher than a bubble point of the core.

9. The pressure coring method of claim 7, further comprising: capturing fluids emitted from the core in a liner disposed within the housing.

10. The pressure coring method of claim 7, wherein the housing of the pressure coring apparatus has a body, and wherein the pressure relief device is operable to maintain a pressure differential across the body of the housing below the target pressure while the pressure coring apparatus is moved out of the wellbore.

11. The pressure coring method of claim 10, wherein the pressure relief device comprises an adjustable pressure relief valve.

* * * * *